United States Patent [19]

Horvay

[11] 4,358,933

[45] Nov. 16, 1982

[54] HOUSEHOLD REFRIGERATOR DEFROST SYSTEM

[75] Inventor: Julius B. Horvay, Louisville, Ky.

[73] Assignee: General Electric Company, Louisville, Ky.

[21] Appl. No.: 225,922

[22] Filed: Jan. 19, 1981

[51] Int. Cl.[3] ..... F25D 21/06

[52] U.S. Cl. ..... 62/155; 62/234

[58] Field of Search ..... 62/234, 155, 154, 158, 62/140, 151

[56] References Cited

U.S. PATENT DOCUMENTS

| | | | |
|---|---|---|---|
| 3,812,306 | 5/1974 | Harris | 200/39 R |
| 4,056,948 | 11/1977 | Goodhouse | 62/155 |
| 4,156,350 | 5/1979 | Elliott et al. | 62/234 X |
| 4,197,717 | 4/1980 | Schumacher | 62/234 X |

*Primary Examiner*—Albert J. Makay
*Assistant Examiner*—Harry Tanner
*Attorney, Agent, or Firm*—Frederick P. Weidner; Radford M. Reams

[57] ABSTRACT

A refrigerator including a compressor, an evaporator and a condenser with a temperature control to energize and de-energize the compressor. There is an electrical defrost heater for periodically warming the evaporator to defrost temperatures which is energized and de-energized by an electrical motor-driven defrost control timer having a predetermined period of run time between initiation of each successive defrost cycle. The defrost control timer is energized to run only when the compressor is energized and the defrost control timer is delayed in running for a period of time each time the compressor is energized.

3 Claims, 3 Drawing Figures

HOUSEHOLD REFRIGERATOR DEFROST SYSTEM

BACKGROUND OF THE INVENTION

This invention relates to a defrost control system for a refrigerator and, more particularly, to a defrost control system that extends the period of time between defrost cycles during periods of moderate or light usage of the refrigerator.

Modern automatically-defrosting refrigerators aree designed to provide proper and efficient operation even during heavy usage conditions, and temperatures within the refrigerated compartment are maintained at levels appropriate for safe storage of food. The frequency of or, expressed alternatively, the interval between successive automatic defrosting operations is selected to prevent excessive accumulation of frost on the evaporator even under heavy usage conditions.

Various forms of variable defrost interval control systems have been developed. For example, adjustable defrost control timers have been provided which permit a user to optimize the defrosting interval for a particular ambient and usage conditions. Furthermore, various so-called "demand defrost" systems have been proposed whereby the refrigerator control system itself varies the interval between successive defrosting operations depending on various sensed parameters such as door openings and ambient humidity. The simplest and most commonly used demand defrost is achieved by connecting the motor in the defrost control timer such that it operates only when the refrigerator compressor is operating in response to a thermostatic temperature control. Thus, under heavy usage conditions, when the compressor runs frequently, the defrost control timer accumulates time at a faster rate. During low usage conditions, the compressor operates less frequently and the defrost control timer accumulates time at a slower rate. Such a defrost system, however, is inappropriate for extended periods of moderate or light usage of the refrigerator as there could be a defrost cycle initiated when in fact one may not be needed.

For example, during an extended vacation period when there are no door openings, the compressor will be still running periodically due to the continuing heat flow into the refrigerated storage space through the insulated walls of the enclosure. Consequently, the defrost control timer will continue to accumulate time, albeit at a slower rate, resulting in a defrost. As there is no moisture entering the insulated enclosure and no frost is accumulating on the evaporator, a defrost is unnecessary, and a waste of electrical energy.

By my invention there is provided a defrost control system for refrigerators which has a defrost control timer to initiate defrost, the timer is set for a predetermined period of compressor run time to initiate defrost, but in addition, a fixed time delay is incorporated before energizing the timer at the beginning of each compressor "on" cycle to extend the period of time between successive defrosts. The energy saving effect of this invention is most pronounced during light or moderate usage of the refrigerator, and diminishes with heavy usage.

SUMMARY OF THE INVENTION

An automatically-defrosting household refrigerator including a compressor, an evaporator and a condenser with a temperature control means to energize and de-energize the compressor is provided with an electrical defrost heater for periodically warming the evaporator to defrost temperatures. The defrost heater is energized and de-energized by an electrical motor-driven defrost control timer having a predetermined period of run time between initiation of each successive defrost cycle. There are means to energize and run the defrost control timer only when the compressor is energized and means are provided to delay the running of the defrost control timer for a period of time each time the compressor is energized.

DESCRIPTION OF THE PREFERRED EMBODIMENT

Figure 1:
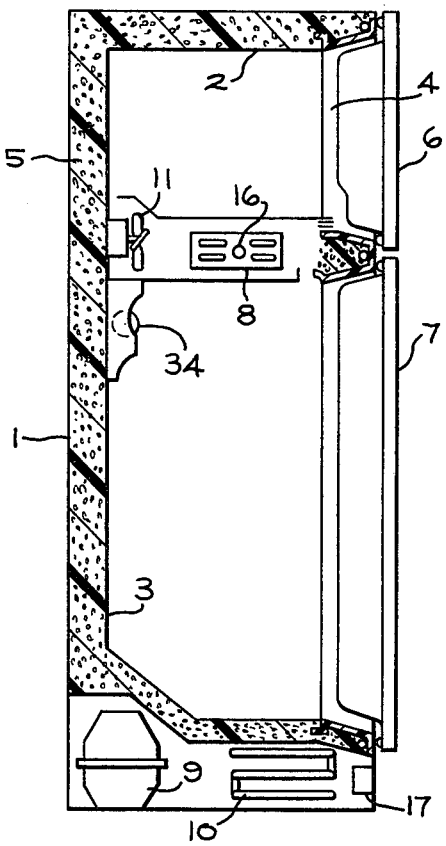
FIG. 1 is a side elevational view of a household refrigerator having a freezer compartment on top and a fresh food compartment below and incorporating one embodiment of the present invention.

With reference to FIG. 1 of the drawing, there is illustrated a refrigerator cabinet including an outer case 1, an upper inner liner 2 defining a freezer storage compartment, and a lower inner liner 3 defining a fresh food storage compartment. The forward edges of both liners are spaced from the forward edges of the case and these spaces are bridged by heat insulating breaker strips 4 while the spaces between the liners and the outer case are filled with suitable insulating material 5. The access openings to the freezer and fresh food compartments are respectively closed by gasketed doors 6 and 7.

Refrigeration for the two compartments is provided by an evaporator 8 positioned in the partition between the two compartments which forms part of the refrigeration system including an electric motor-driven compressor 9 and a condenser 10. A fan 11 rearwardly from evaporator 8 provides means for circulating air from the two compartments over the evaporator 8 and back into the compartments.

A thermostatic control means generally indicated by the numeral 34 including a temperature sensing means is provided for automatically controlling the operation of the compressor 9 to maintain the temperature within the fresh food compartment within a controlled range. Also, in accordance with the usual practice, this thermostatic control means can be manually adjusted for the desired temperature in the fresh food compartment and also it can be moved to an "off" position whereby the compressor 9 is de-energized regardless of the temperatures within the cabinet.

Evaporator 8 operates at temperatures below freezing and for the purpose of periodically moving accumulated frost from the evaporator surfaces, there is provided an electrical defrost heater 16, which is periodically energized by operation of a defrost control timer 32 located in a housing 17.

Figure 2:
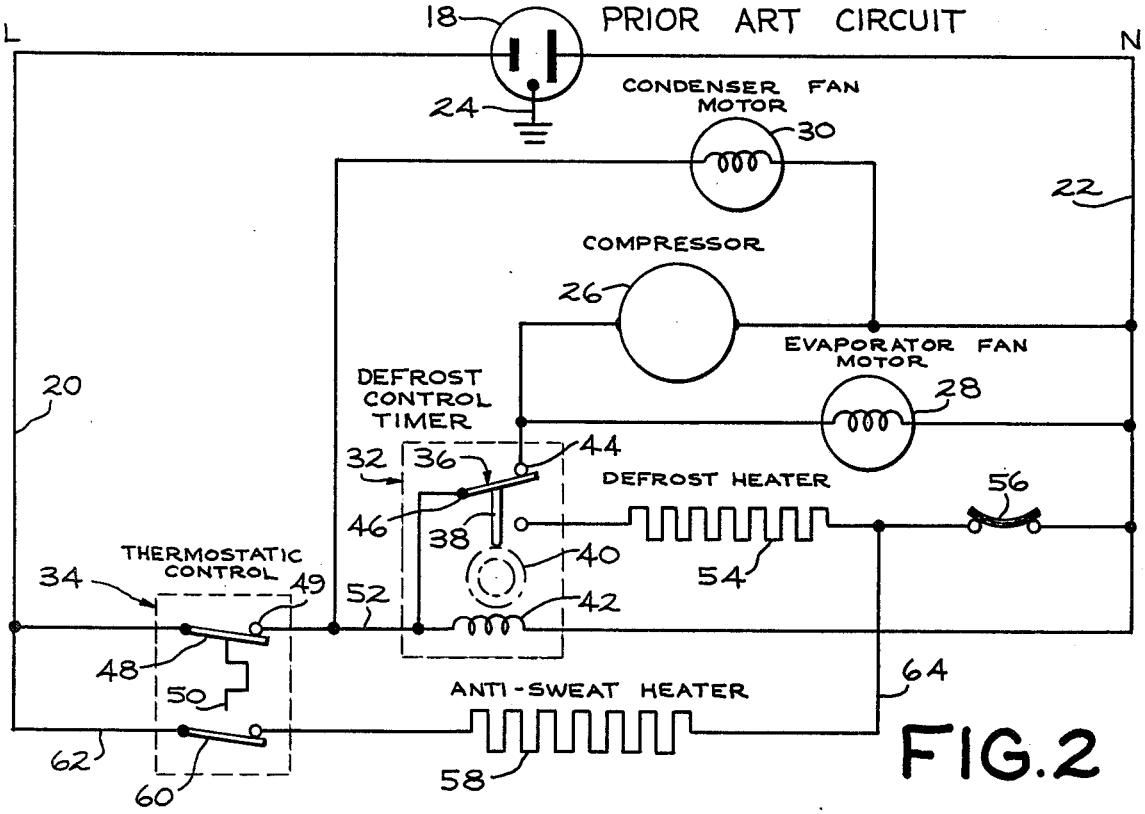
FIG. 2 is an electrical circuit diagram of a refrigerator control system according to the prior art.

The control circuitry and components for controlling the normal and defrost operation of a prior art refrigerator is illustrated in FIG. 2 of the drawing. A conventional power plug 18 supplies L and N supply conductors 20 and 22, and has a connection 24 to ground the frame to the refrigerator. The refrigeration system includes a compressor motor 26 and an evaporator fan motor 28 connected in parallel. The refrigeration system further includes a condenser fan and motor 30 for forced-air cooling of the condenser 10. For controlled operation of the refrigeration system, the compressor and evaporator fan motors 26 and 28 are connected to the L supply conductor 20 through the defrost control timer 32 and through the thermostatic control means 34 for controlling the interior temperature of the refrigerator. The compressor, evaporator fan and condenser fan motors 26, 28, and 30 each have return electrical connections to the N supply conductor 22.

The defrost control timer 32 includes a cam-operated, single-pole double-throw switch 36 operated through a link 38 by a defrost control cam 40 driven by a timing motor 42. When the defrost control switch 36 and the cam 40 are in the cooling position shown, the compressor and evaporator fan motors 26 and 28 are connected through the switch terminals 44 and 46 and through the thermostatic control means 34 to the L supply conductor 20.

The particular thermostatic control means 34 includes a temperature sensing means or thermostat 48 which is a conventional hydraulic type normally employed in refrigerators, and includes a remote temperature-sensing bulb, represented by an element 50 at the end of a small-diameter tube. The thermostat 48 has a range of adjustment for the normal fresh food compartment temperature which setting is normally between 33° F. and 43° F., with 38° F. being a nominal setting. It will be understood that the temperature sensing means 48 operates independently of the defrost control timer 32.

In the operation of the prior art circuitry shown in FIG. 2, thus far described, the thermostat 48 is enabled to cycle the compressor motor 26, the evaporator fan motor 28 and the condenser fan motor 30 as required to maintain the temperature in the refrigerated compartment. Each time the enabled thermostat 48 closes, power is supplied through contact 49 along a conductor 52 to the defrost control timing motor 42 to rotate the defrost control cam 40. In order to initiate automatic defrosting operations, the timing of motor speed and cam arrangement are typically such that after every 5½ hours of timing motor running time, the cam 40 switches the defrost control switch 36 to the lower position, de-energizing the compressor and evaporator fan motors 26 and 28, and energizing a defrost heater 54. The defrost control switch 36 remains in the lower position for a period of approximately 30 minutes. The N return for the defrost heater 54 is connected through a defrost-terminating bimetallic switch 56 which is adjusted to open at approximately 50° F. Under normal frost loading condition, the evaporator is completely defrosted and the bimetallic switch 56 opens within the 30-minute defrost duration period determined by the defrost control cam 40 and the defrost control timing motor 42.

While the particular defrost control timer 32 illustrated is an electro-mechanical device, it will be apparent that various other timing means may be employed. For example, an electronic timer may be used, using either RC or digital counter timing elements. Depending upon the precise timer employed, a different means for interrupting the timer may be appropriate, and not necessarily a simple interruption of power. The refrigerator control circuit usually further includes a conventional anti-sweat heater 58, which serves to prevent condensation forming on the visable outer portions of the refrigerator cabinet. The anti-sweat heater is energized through a manually operated power saver switch 60 and a conductor 62 when the switch is in its closed position as shown in the drawing. The anti-sweat heater 58 is de-energized when the power saver switch 60 is manually opened. N return conductor 64 for the anti-sweat heater 58 is connected through the defrost-terminating switch 56 to the N power source conductor 22 to prevent the heater 58 from operating during those periods when the evaporator temperature exceeds 50° F. during defrost operations.

Figure 3:
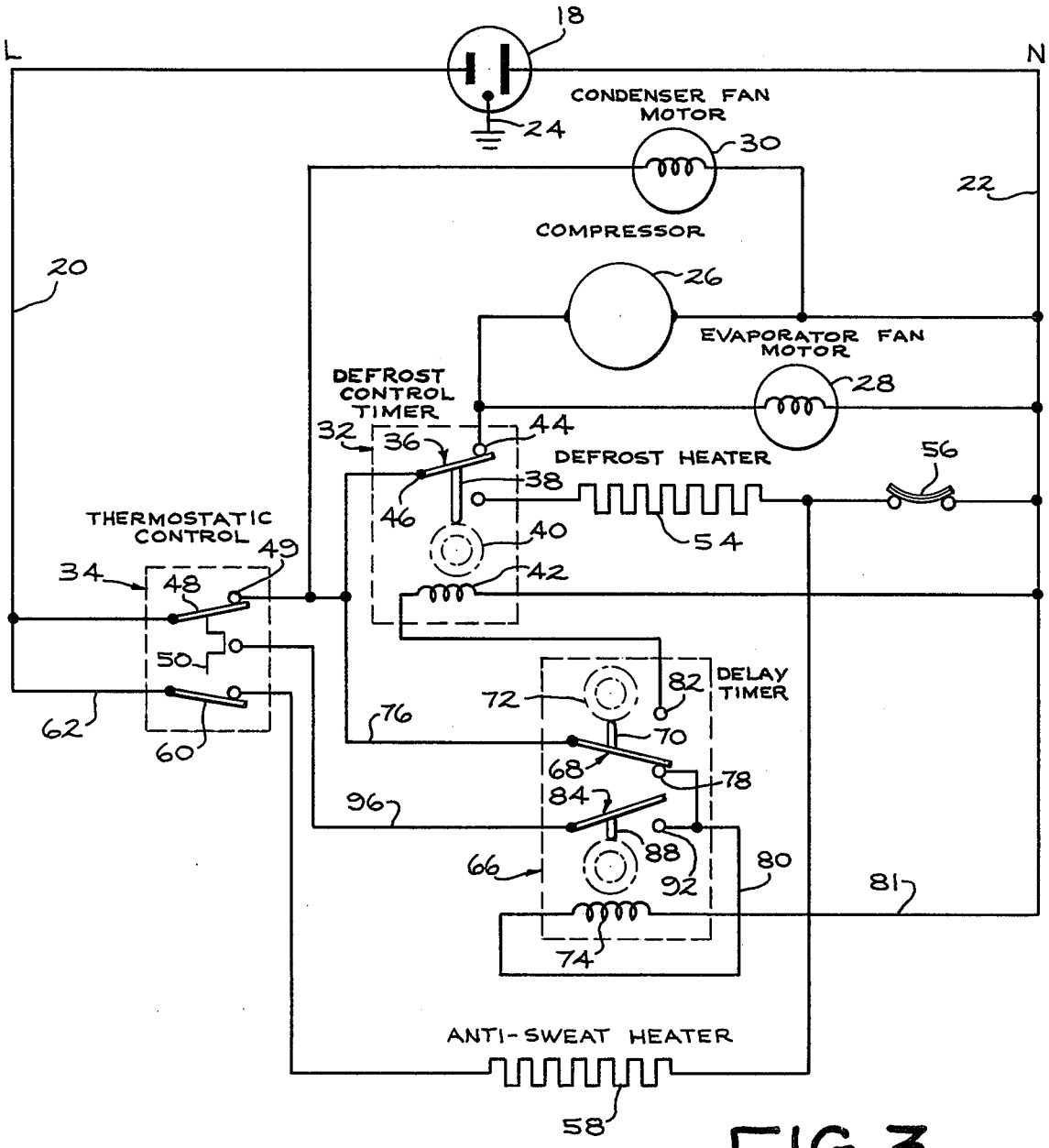
FIG. 3 is an electrical circuit diagram of a refrigerator control system according to one embodiment of the present invention.

Referring now to FIG. 3, there is shown a schematic diagram of a refrigerator control circuit according to the preferred embodiment of the invention. The circuit of FIG. 3 differs from the circuit of FIG. 2 as will be discussed below. It will appreciated that the circuit of FIG. 3 remains unchanged in other respects and a complete description thereof is not repeated.

The modification of the prior art defrost control circuit shown in FIG. 2 involves primarily the introduction of a defrost interval extending timer or delay timer 66 which is interposed between L conductor 20 and the defrost control timer 32. The delay timer 66, which may also be located in housing 17, includes a cam-operated, single pole, double throw switch 68 operated through a link 70 by a cam 72 driven by a delay timing motor 74. When the defrost control switch 36 and the cam 40 are in the cooling position shown, the compressor and evaporator fan motors 26 and 28 are connected through the switch terminals 44 and 46 and through the thermostatic control means 34 to the L supply conductor 20. Also, the delay timer 66 has switch 68 connected through conductor 76 to contact 49 of the thermostatic control 34 and to the L supply conductor 20. Switch 68 has contact 78 connected to the delay timing motor 74 through conductor 80. Delay timing motor 74 is connected to the N supply conductor 22 through conductor 81. Thus, when the thermostatic control 34 is closed as shown in FIG. 3 and the compressor 26 is energized, delay timing motor 74 is energized and rotates cam 72 for a period of time, say 10 minutes. Upon completion of the rotation of cam 72, the cam through link 70 moves switch 68 from contact 78 to contact 82 thus completing the circuit to timing motor 42 allowing the timer motor 42 to be energized and rotate cam 42 as previously described in connection with the prior art circuit of FIG. 2. With the above described arrangement, each time the compressor 26 is energized, the delay timer 66 operates to prevent the defrost timer 42 from starting to run for a delayed period of time thus extending the amount of accumulated compressor run time previously preset in the defrost control timer 32.

The delay timer 66 also includes a switch 84 operated by a cam 86 through a link 88 to make and break an electrical connection with contact 92 which is connected to the delay timing motor 74 through conductor 80 when switch 84 is moved to make electrical connection with contact 92. When the thermostatic control 34, by means of thermostat 48, opens to de-energize the compressor 26 to operate, switch 48 moves from contact 49 to contact 94 thus completing a circuit from L supply conductor 20 through switch 48, contact 94 and conductor 96 to switch 84. With switch 84 moved to make electrical connection with contact 92, current will pass through conductor 80 to the delay timing motor 74 so that cam 86 will be rotated during the compressor 26 off time to reset the delay timer 66. Thus, the delay timer 66 will be operational the next time the thermostatic control 34 operates to start the compressor 26.

While the preferred embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. In a refrigerating system including a compressor, an evaporator and a condenser;

(a) temperature control means to energize and de-energize the compressor, (b) an electrical defrost heater for periodically warming the evaporator to defrost temperatures, (c) an electrical motor-driven defrost control timer to energize and de-energize the defrost heater and having a predetermined period of run time between initiation of each successive defrost cycle, (d) means to energize and run the defrost control timer only when the compressor is energized, and (e) means to automatically delay the running of the defrost control timer for a fixed period of time each time the compressor is energized.

2. In the refrigerating system of claim 1 wherein the means to delay the running of the defrost control timer is an electro-mechanical timer that runs for a set period of time after energization of the compressor and at the end of the run period, switch means are actuated to energize the defrost control timer.

3. In the refrigerator of claim 2 wherein the delay timer is reset prior to the next successive energization of the compressor.

* * * * *